United States Patent [19]

Murzyn

[11] Patent Number: 4,579,596

[45] Date of Patent: Apr. 1, 1986

[54] IN-SITU REMOVAL OF OILY DEPOSITS FROM THE INTERIOR SURFACES OF CONDUITS

[75] Inventor: Patrick J. Murzyn, Houston, Tex.

[73] Assignee: Union Carbide Corporation, Danbury, Conn.

[21] Appl. No.: 667,335

[22] Filed: Nov. 1, 1984

[51] Int. Cl.[4] ..... B08B 9/00

[52] U.S. Cl. ..... 134/7; 134/8; 34/9; 34/12

[58] Field of Search ..... 134/7, 8, 9, 21, 22, 134/13; 15/3.2, 302, 320, 22, 56; 51/320, 321, 411, DIG. 40, 307, 308, 309; 137/15; 34/9, 12, 104, 95

[56] References Cited

U.S. PATENT DOCUMENTS

| | | | |
|---|---|---|---|
| 1,830,757 | 11/1931 | Hartmann | 51/308 |
| 4,297,147 | 1/1981 | Nunciato et al. | 134/7 |
| 4,482,392 | 11/1984 | Pollock et al. | 134/7 |

*Primary Examiner*—Richard V. Fisher
*Assistant Examiner*—Sharon T. Cohen
*Attorney, Agent, or Firm*—Alvin H. Fritschler

[57] ABSTRACT

The in-situ cleaning of conduits containing oily deposits is facilitated by the concurrent passage of cleaning particles and a non-agglomerating drying agent therethrough in a propelling gas stream. In cycling cleaning operations, the preliminary injection of drying agent into the conduit prior to said concurrent use of cleaning particles and drying agent further enhances the overall in-situ cleaning operation.

20 Claims, No Drawings

IN-SITU REMOVAL OF OILY DEPOSITS FROM THE INTERIOR SURFACES OF CONDUITS

BACKGROUND OF THE INVENTION

1. Field of the Invention

This invention relates to the cleaning of the interior surfaces of conduits. More particularly, it relates to the enhanced in-situ cleaning of conduits having oily deposits on the interior surfaces thereof.

2. Description of the Prior Art

The Sandjet process is a well known and successful process for the in-situ cleaning of the interior surfaces of conduits used for the transport and/or processing of fluids, solids or a mixture thereof. The conduits thus cleaned include fired heater tubes used in hydrocarbon or chemical processing applications, pipelines heat exchange tubes and the like. In the practice of the Sandjet process for such in-situ cleaning operations, cleaning particles are entrained in a propelling fluid stream and are introduced into the conduit to be cleaned at a velocity sufficient to effect the desired cleaning action. For pipeline applications, the cleaning particles commonly employed generally comprise an abrasive material, such as flint, whereas in various other in-situ cleaning applications, cleaning particles such as non-angular, non-abrasive, steel shot may be advantageously employed.

In fired heater tube applications, the Sandjet process is used to decoke and clean the interior surfaces of furnace tubes, as is described in the Nunciato et al patent, U.S. Pat. No. 4,297,147, issued Oct. 27, 1981. As described therein the carrying out of the in-situ Sandjet process using steel shot cleaning particles provides significant advantages compared with the known alternative decoking approaches, such as turbining, hydroblasting and steam-air decoking. In addition to the advantages noted in the patent, there is a growing appreciation in the art of the energy savings that can be derived as a result of the decoking of furnace tubes by means of the Sandjet process as compared with the results obtainable by the most frequently used alternative approach, i.e. the above-mentioned steam-air decoking. The flexibility of the Sandjet process and its scope of application have been extended, particularly with regard to the removal of difficult-to-remove deposits, by the use of regular, non-random cleaning particles having less than spherical symmetry. Upon the propelling of such particles through the conduit to be cleaned, an advantageous balance of desired cleaning action and undesired erosion of the interior surfaces of the conduit is achieved, as is disclosed in C. B. Pollock et al, U.S. Ser. No. 377,788, filed May 13, 1982, now U.S. Pat. No. 4,482,392.

It is recognized, however, that further development and improvement are required in order to extend the benefits and advantages of the in-situ Sandjet cleaning process to an ever greater range of application. The inherent advantages of this in-situ approach are such as to create a desire, and even a genuine need, in the art for such development of the flexibility and the predictability of the Sandjet process as applied to applications presenting obstacles to the full and effective extension of said benefits and advantages thereof on a routine commercial basis. One cleaning application in which such development is desired pertains to the removal of oily or tar-like deposits that may accumulate on the interior surfaces of furnace tubes, pipelines or other conduits employed in certain services. It is often very difficult, if not impossible, to effectively remove such oily deposits by the economically feasible practice of the Sandjet process. The problem encountered is that a wet or oily deposit slows-down or captures the cleaning particles passing through the conduit obviating the effectiveness of the cleaning action. For this reason, the providing of Sandjet process services for the removal of oily deposits is commonly preceded by a steam and/or solvent wash of the oily deposit. It will be appreciated, however, that the necessity for carrying out such deposit wash operations adds appreciably both to the time and cost of the overall decoking or other cleaning operation, thus obviating some of the benefits sought to be derived from the in-situ deposit removal Sandjet cleaning process. The improvement of the Sandjet process with respect to the removal of oily deposits, therefore, would be of practical advantage in the art.

It is an object of the invention, therefore, to provide an improved process for the in-situ removal of oily deposits from the interior surfaces of conduits.

It is another object of the invention to provide an in-situ cleaning process obviating the need for the preliminary washing of oil deposits desired to be removed from the interior surfaces of furnace tubes, pipelines and the like.

It is a further object of the invention to enhance the effectiveness of the cleaning action of particles propelled through the interior of a conduit to be cleaned.

SUMMARY OF THE INVENTION

By the passage of a non-agglomerating drying agent through a conduit containing an oily deposit on the interior surfaces thereof concurrently with the passage of cleaning particles through said conduit the in-situ cleaning action of the cleaning particles upon impact with the interior surfaces of the conduit containing said oily deposit to be removed is enhanced. In cyclic cleaning operations, an injection of said drying agent into the conduit prior to said drying agent-cleaning particle injection serves to coat the oily surface and to further enhance the removal thereof by said in-situ cleaning technique.

DETAILED DESCRIPTION OF THE INVENTION

The objects of the invention are achieved by use of a non-agglomerating drying agent in conjunction with the practice of the in-situ Sandjet cleaning process. Such use enables the cleaning particles being propelled through the conduit having an oily deposit on the interior surfaces to effectively remove said deposit without the substantial embedding of said cleaning particles in or on the oily deposit being removed that has precluded the effective in-situ cleaning thereof without the necessity for preliminary steam and/or solvent wash operations.

In the practice of the invention, the use of calcined diatomaceous earth as the drying agent has been found particularly advantageous and effective. Thus, such use of diatomaceous earth is convenient, economical and generally suitable in practical commercial operations of the Sandjet process as applied to the removal of oily deposits. It will readily be appreciated, however, that the invention can also be practiced by the substitution of other non-agglomerating drying agents for said convenient diatomaceous earth, with such drying agent and the cleaning particles employed for the desired Sandjet process cleaning action effectively co-acting so as to enable an oily deposit to be removed in a manner typically not accomplished to a commercially satisfactory degree in the conventional practice of the Sandjet process without the modification of the invention as herein described and claimed.

It will be understood that the invention can be practiced using any cleaning particles that would ordinarily be employed for the in-situ cleaning of conduits by the Sandjet process apart from the oily or tar-like character of the deposits to be removed in the embodiments to which the invention is specifically limited. As indicated above, such an oily or tar-like deposit is such that, upon impact of the cleaning particles therewith during their passage through the conduit, the particles tend to become slowed-down in velocity and captured by the deposit rather than to being propelled through the conduit with a sufficient number of impacts and angles of impact to effectively remove the deposit from the interior surfaces of the conduit, such as a furnace tube, i.e. fired heater tubes to be decoked, or a pipeline to be cleaned, or the like. As used herein, the terms "oily deposits", "oily or tar-like deposit" and "oily or tar-like character of the deposits" are intended to denote any deposit on the interior surfaces of a conduit that exhibits a viscous, fluid-like behavior, such as to plastically deform and to cause the slowing down or capture of cleaning particles being propelled through the conduit. Such deposits include those containing liquid hydrocarbons as the source of the oily or tar-like character thereof, but also include other fluids, including water, sufficient to impart a similar mud-like, viscous character to the deposit having such a fluid adsorbed into the matrix of the solids constituting said deposit. The cleaning particles may be abrasive materials, such as flint, grit or sand, non-angular, non-abrasive particles, such as steel shot, or various other cleaning particles that may be effective or desirable for particular Sandjet process cleaning operations. As indicated above, cleaning particles having a regular non-random configuration with less than spherical symmetry are particularly desirable in certain applications wherein effective cleaning without undue erosion may be necessary. The decoking of furnace tubes containing difficult-to-remove deposits without undue erosion of return bends, or the particularly effective removal of very difficult to remove deposits especially where a companion increase in erosion can be tolerated, as in certain high heat duty furnace decoking applications in which plugged headers may be employed in place of welded return bends, are examples of instances in which the use of special cleaning agents may be desirable in place of flint or grit, on the one hand, or steel shot on the other. Cut wire washers, punched out slugs and particles having either triangular, square, rectangular, hexagonal, or elliptical configurations are examples of such special cleaning agents suitable for use in particular applications of the invention. It should be noted that such particles as initially employed may have either sharp edges at the opposite ends thereof or such ends that are rounded in nature. The spherical particles may include cylindrical or other configurations in which the diameter or equivalent dimension is either less than the length thereof, as in cut wire, or greater than the length thereof as in the case of washers. It should also be noted that abrasive flint has been used to dry surface water-containing deposits in furnaces. Flint is not an efficient drying agent, however, and may cause highly undesirable erosion, as at furnace tube bends, rendering it generally undesirable for such water removal purposes. Calcined diatomaceous earth has been employed as a suitable substitute for abrasive flint in the removal of surface water, such as an adherent film or layer or water in a furnace. Laboratory and field tests have shown that calcined diatomaceous earth is effective in the drying of such wet, water-containing furnaces. In the practice of the invention as herein described and claimed, on the other hand, the conduit to be cleaned is one containing an oily or tar-like deposit, and the non-agglomerating drying agent is one, such as said calcined diatomaceous earth, having a drying capability with respect to said oily deposit. By the use of such a non-agglomerating drying agent concurrently with the cleaning particles, the practice of the Sandjet process results in the removal of a dust-like exhaust stream from the exit end of the conduit being treated, said dust stream containing particles of the deposit being removed from the interior surfaces of the conduit in addition to quantities of the cleaning particles entrained in the propelling gas stream. Such an effective cleaning action is not achieved in efforts to employ cleaning particles in a conventional Sandjet process embodiment, without concurrent use of a drying agent, as applied to an oily deposit with the necessity for exposing the deposit to extensive pre-treatment in the form of steam and/or solvent wash and/or dry heating operations.

The operating conditions for the practice of the invention will generally be as disclosed in the Nunciato et al. patent, U.S. Pat. No. 4,297,147, referred to above. Thus, the cleaning particles will be entrained in the propelling gas stream that is passed through the furnace tubes or other conduits to be cleaned at a gas flow velocity corresponding to an outlet gas velocity of from about 5,000 feet per minute up to the sonic velocity of the propelling gas. The gas is typically nitrogen, with the sonic velocity being about 69,000 feet per minute. It will be understood that other propelling gases can be employed so long as they are compatible with the conditions pertaining to the conduit being cleaned. Air is sometimes employed as the propelling gas, the sonic velocity of air being about 68,000 feet per minute. Those skilled in the art will appreciate that the sonic velocity is the speed of sound in any particular propellant gas employed, and is the maximum velocity at which the gas can be passed through a pipeline. In practical commercial applications, the outlet gas velocity from the conduit being cleaned is from about 7,000 to about 40,000 feet per minute, with desirable results being frequently obtained by convenient operations at a gas velocity of between 14,000 and about 20,000 feet per minute. The cleaning particles entrained in the gas stream are generally furnished at a particle concentration of from about 0.1 to about 10.0, preferably from about 0.1 to 1.0, pounds of cleaning particles per pound of propellant gas. As in the Sandjet process as heretofore practiced, the flow of propelling gas is continued without the entrainment of particles therein, at intervals during the overall cleaning operation, so as to remove loose debris from the conduit. After such intervals, except at the end of the cleaning operation, the flow of propelling gas is continued with the cleaning agents entrained therein. The flow of the said particle-entrained gas stream to the conduit being cleaned is maintained for a time sufficient to effect cleaning of the conduit. It is common practice, based on experience, to maintain the flow of the gas stream until the quantity of particles in a supply pot is exhausted, after which loose debris is removed while the supply pot is refilled. For purposes of the invention, calcined diatomaceous earth or other non-agglomerating drying agent for an oily deposit is conveniently metered into the propelling gas stream for the cleaning particles in a suitable amount to overcome the tendency of the deposit to slow-down and capture cleaning particles so that said cleaning particles do not become embedded in or on the deposit in a manner obviating the effective in-situ cleaning action of such particles.

Those skilled in the art will appreciate that the amount of said calcined diatomaceous earth or other such drying agent employed will vary depending upon the overall conditions applicable to any given Sandjet process application. Thus, the nature of the deposit to be removed and of its oily character, the cleaning particles employed and the outlet gas velocity of the propelling gas stream will all effect the amount of said drying agent employed in a given cleaning application. Thus, the amount of the drying agent employed may range from about 5% to about 50% or more by weight based on the amount of cleaning particles passed through the conduit in the propelling gas stream, with from about 10% to about 35% by weight of said drying agent being employed in typical cleaning operations. In an illustrative example of the invention, steel shot is entrained in a propelling gas stream of nitrogen at an outlet gas velocity of 20,000 feet per minute and passed into furnace tubes to be decoked by the in-situ cleaning action of the steel shot by impact action during the course of the passage of said steel shot down the straight sections and around the bends of said furnace tubes. The steel shot is employed at a particle concentration of about 1.0 pound of nitrogen gas. To overcome the tendency of the steel shot to become embedded in or on the oily deposit, calcined diatomaceous earth is metered into the propelling gas stream so as to provide for the concurrent passage of about 25% by weight of said drying agent through the bed based on the weight of steel shot being propelled therethrough for the desired cleaning purpose. The presence of said diatomaceous earth prevents the steel shot from becoming embedded in or on the oily deposit being removed so as to facilitate the desired impact cleaning action of the shot particles and the effective removal of the deposit from the interior surfaces of the furnace tubes. The overall cleaning operation is carried out in a series of cleaning runs wherein the flow of nitrogen is continued until the quantity of cleaning particles, i.e. steel shot, in a supply pot is exhausted. While the supply pot is being refilled, the flow of nitrogen, without entrained cleaning particles and drying agent, through the furnace tubes is employed to remove loose debris from the furnace tubes. In the preferred practice of the invention, the diatomaceous earth or other non-agglomerating drying agent is injected into the furnace tubes or other oily deposit containing conduits to be cleaned prior to resuming the concurrent passage of said drying agent and said cleaning particles through the conduit in the next succeeding cleaning run therein. For this purpose, diatomaceous earth is metered into the propelling nitrogen steam without the entrainment of the steel shot therein. This preliminary or initial injection of cleaning particles through the furnace tubes or other conduits serves to coat the oily surface of the deposit remaining to be removed, thus facilitating the drying thereof so as to enhance the effectiveness of the cleaning action of the steel shot upon subsequent concurrent passage of steel shot and cleaning particles through the conduit. The initial injection of said drying agent through the furnace tubes prior to concurrent cleaning particles-drying agent injection therein in the cleaning runs of cyclic Sandjet process application is desirably carried out until the oily deposit is substantially coated by said drying agent as evidenced by the exhaust of a dust-like stream of propelling gas and entrained drying agent from the conduit being treated. It has been found that the preliminary injection of the non-agglomerating drying agent into the conduit advantageously serves to remove any cleaning particles that may have become embedded in the oily deposit during preceding cleaning runs, further enhancing the overall effectiveness of the modified Sandjet process operation of the invention. It will be appreciated that the non-agglomerating character of the drying agent is of significance to the effectiveness of the operation. If an agglomerating-type material were attempted to be used as the agent for drying oil, its agglomerating tendency would preclude its effective coating and oil-drying functions, and the existence of agglomerates of such material would interfere with the effective cleaning action of the steel shot or other such particles that is dependent upon the repeated impact of the cleaning particles with the deposit to be removed throughout the length of the conduit.

For purposes of the invention, the term "non-agglomerating" will be understood to mean a material that will adsorb and/or absorb substantial amounts of the oily deposit without redeposition of said deposit at bends, flow obstructions or other such sites within the conduit being cleaned. While a clay, for example, would be of a highly adsorptive material, clay is of an agglomerating nature such as to cause the oily deposit to stick to the above-indicated sites within the conduit downstream of the point of initial adsorption and/or absorption. The characteristics of the drying agents employed for purposes of the invention may thus be summarized as (a) high adsorptive or absorptive properties with respect to the oily deposit, (b) a non-agglomerating character as said term is defined above, coupled with (c) a non-abrasive or non-erosive nature with respect to the furnace tube, pipeline or other such conduit being cleaned. While clay is both highly absorptive and adsorptive and non-erosive, it is not non-agglomerating as indicated above and thus is unsuited for use in the practice of the invention. Sand, on the other hand, is non-agglomerating in nature, but is not sufficiently absorptive or adsorptive for purposes of the invention and is generally too erosive for most applications. Flint is also non-agglomerating, but is very erosive in nature and is not of a sufficiently adsorptive or absorptive nature for use as the drying agent of the invention. Calcined diatomaceous earth, however, is highly adsorptive and/or absorptive, is of a non-agglomerating character and is essentially non-erosive. As such diatomaceous earth is readily available as a low cost material, it is the generally referred drying agent, at the present time, for use in the practice of the invention. It will be appreciated, however, that other available materials having the desired characteristics, such as molecular sieve materials, may also be employed in the various embodiments of the invention. The preferred calcined diatomaceous earth is commonly available from Eagle Picher Company of Ohio. In addition to its highly absorptive or adsorptive and non-agglomerating properties, such diatomaceous earth is non-abrasive or non-errosive as evidenced by its relatively low hardness of 2.3–2.5 on the Mohs scale as compared to 8+ for steel and 9+ for flint. Such calcined diatomaceous earth is available in various grades having somewhat different particle size ranges based upon the amount (%) cumulatively retained on standard NBS sieve size screens. As injected into the conduit being cleaned in the practice of the invention, MP 77 grade material, for example, comprises 7, 14, 39, 78 and 99% (min.) retained in Nos. 6, 8, 10, 20 and 80 screens, respectively, with 1% maximum comprising −80 mesh material. MP 85 material comprises 2/5, 40/50, 80/90 and 99% (min.), typically 99.8%, retained on Nos. 6, 10, 20 and 80 screens, respectively, with 1% maximum comprising −80 mesh material. Those skilled in the art will appreciate that the drying agent employed in the invention will be used in such particle size ranges, as above, that can be conveniently and satisfactorily injected into the conduit, said particles tending to break-up during the transit through the conduit to produce a dust-like stream effective for purposes of the invention. Conventional dust suppression means are, of course, provided at the outlet end of the conduit. In attempts to employ the Sandjet process for the removal of oily deposits without incorporation of the feature of the invention, it was found that the cleaning particles, e.g., steel shot, did not pass through the conduit and discharge from the outlet end thereof as would typically be expected. To the contrary, only very small amounts of said cleaning particles are found to exit from the conduit, essentially without the dust-like presence of cleaning particles and removed particles of the deposit ordinarily exiting from the conduit in the typical operation of the Sandjet process. Such small amounts of discharged particles are obtained in the form of a sludge. By the practice of the invention with respect to the in-situ cleaning of conduits containing oily deposits, however, the cleaning particles are able to readily pass through the conduit for effective in-situ cleaning, with such cleaning particles, drying agent and removed debris being propelled from the conduit, as in the practice of the Sandjet process for non-oily deposits, in a dust-like stream indicative of effective in-situ cleaning within the conduit despite the presence of an oily deposit on the interior surfaces of the conduit.

It will be seen from the above that the invention advantageously extends the scope of application of the Sandjet process to the effective treatment of conduits containing oily deposits therein. Since the Sandjet process for the in-situ cleaning of conduits has become increasingly accepted, predictable and reliable for practical commercial applications, such useful extension of the practical commercial application thereof fulfills a desire in the art growing out of appreciated inherent advantages of the in-situ cleaning approach. The invention, in bringing the benefits of the Sandjet process to a wider range of industrial processors desiring to avail themselves of services based on said in-situ cleaning process, thus represents a desirable advance in the art of furnace tube decoking and other conduit cleaning applications.

I claim:

1. In the in-situ process for cleaning the interior surfaces of conduits for the transport and/or processing of fluids, solids or mixtures thereof in which cleaning particles entrained in a propelling gas stream are passed through the conduit to be cleaned at an outlet gas velocity of from about 5,000 feet per minute up to the sonic velocity of the propelling gas, the improvement in the removal of an oily deposit comprising passing a drying agent through the conduit to be cleaned concurrently with the passage of said cleaning particles therethrough, said drying agent being (a) highly adsorptive or absorptive with respect to said oily deposit, (b) non-agglomerating so that, upon the adsorption and/or absorption of substantial amounts of the oily deposit during passage of said drying agent through the conduit to be cleaned, redeposition of said deposit at bends or other flow obstruction sites within the conduit downstream of the point of initial adsorption and/or absorption is effectively precluded, and (c) non-abrasive or non-erosive with respect to the surface of the conduit being cleaned, said drying agent being employed in an amount sufficient to effectively preclude the substantial embedding of said cleaning particles in or on the oil deposit being removed, whereby the effective in-situ cleaning action of the cleaning particles is enhanced, facilitating the application of said in-situ cleaning process to the treatment of conduits containing such oil deposits therein.

2. The process of claim 1 in which said conduit comprises fired heater tubes to be decoked in the cleaning process.

3. The process of claim 1 in which said conduit to be cleaned comprises a pipeline.

4. The process of claim 1 in which said non-agglomerating drying agent comprises calcined diatomaceous earth.

5. The process of claim 4 in which said cleaning particles comprise steel shot.

6. The process of claim 4 in which said cleaning particles have a regular, non-random configuration with less than spherical symmetry.

7. The process of claim 4 in which said cleaning particles comprise flint or grit.

8. The process of claim 4 in which said outlet gas velocity is from about 7,000 to about 40,000 feet per minute.

9. The process of claim 1 in which said non-agglomerating drying agent is employed in an amount within the range of from about 5% to about 50% by weight based on the amount of cleaning particles passed through said conduit.

10. The process of claim 9 in which said non-agglomerating drying agent comprises calcined diatomaceous earth.

11. The process of claim 10 in which from about 10% to about 35% by weight of said drying agent is employed based on the amount of cleaning particles passed through said conduit.

12. The process of claim 10 in which said conduit comprises fired heater tubes to be decoked in the cleaning process.

13. The process of claim 10 in which said conduit to be cleaned comprises a pipeline.

14. The process of claim 1 and including injecting non-agglomerating drying agent into said conduit containing the oily deposit to be removed prior to said concurrent passage of said drying agent and said cleaning particles through said conduit in a cleaning run, the initial injection of said drying agent serving to coat the oily surface of the deposit to be removed and to facilitate the drying thereof.

15. The process of claim 14 in which, in each cleaning run, the flow of the cleaning particle-entrained gas stream is continued until the quantity of cleaning particles in a particle supply pot is exhausted, the preliminary injection of non-agglomerating drying agent into the conduit serving also to remove any cleaning particles that may have become embedded in or on the oily deposit during preceding cleaning runs.

16. The process of claim 15 in which said non-agglomerating drying agent comprises calcined diatomaceous earth.

17. The process of claim 16 in which said conduit comprises fired heater tubes to be decoked in the cleaning process.

18. The process of claim 16 in which said conduit to be cleaned comprises a pipeline.

19. The process of claim 17 in which said cleaning particles comprise steel shot.

20. The process of claim 19 in which said outlet gas velocity is from about 7,000 to about 40,000 feet per minute.

* * * * *